United States Patent [19]

Vanderminden

[11] 4,201,416

[45] May 6, 1980

[54] CANOPY CONSTRUCTION FOR OUTDOOR FURNITURE

[75] Inventor: Robert D. Vanderminden, Granville, N.Y.

[73] Assignee: The Telescope Folding Furniture Co., Inc., Granville, N.Y.

[21] Appl. No.: 903,113

[22] Filed: May 5, 1978

[51] Int. Cl.[2] ..... A47C 7/10

[52] U.S. Cl. ..... 297/184

[58] Field of Search ..... 297/184, 188, 16, 19, 297/21, 22, 23, 28, 29, 30; 248/214, 219.4, 218.4, 230, 231, 225.3; 5/344

[56] References Cited

U.S. PATENT DOCUMENTS

| | | | |
|---|---|---|---|
| 2,109,881 | 3/1938 | Goldberg | 5/344 |
| 2,747,653 | 5/1956 | Obradovich | 297/184 |
| 3,243,230 | 3/1966 | Otto | 297/184 |
| 3,738,703 | 6/1973 | Kunimatu | 297/184 |
| 4,030,748 | 6/1977 | Brock | 297/184 |

FOREIGN PATENT DOCUMENTS

| | | | |
|---|---|---|---|
| 594730 | 9/1925 | France | 297/184 |

*Primary Examiner*—William H. Schultz
*Assistant Examiner*—Peter A. Aschenbrenner

[57] ABSTRACT

The U-shaped clamps which secure the canopy to the chair are constructed with a reversely bent leg to prevent pivoting of the canopy towards the front of the chair. Each clamp is made of a one-piece metal blank which is shaped to fit over the chair frame and to receive a canopy leg.

12 Claims, 5 Drawing Figures

Fig. 3.
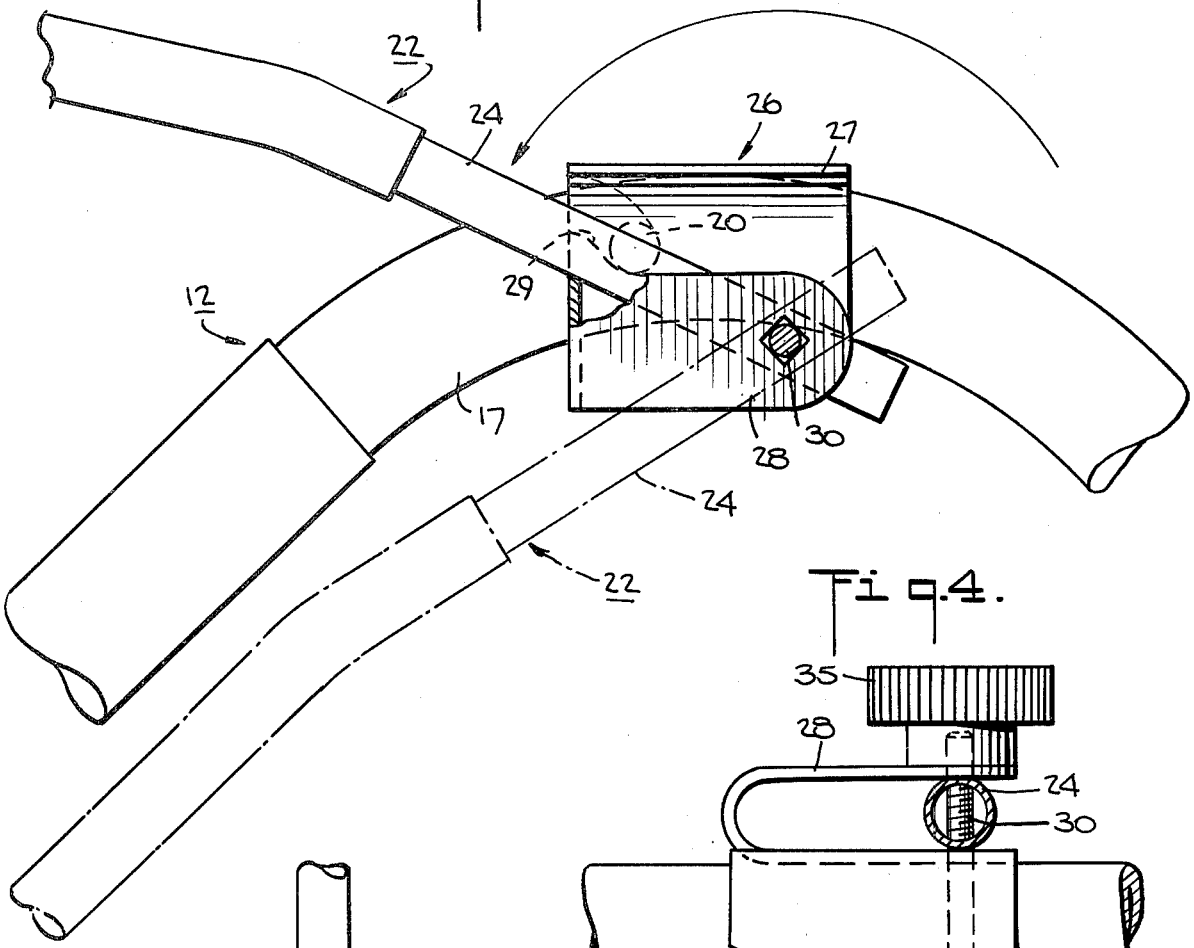
Fig. 4.
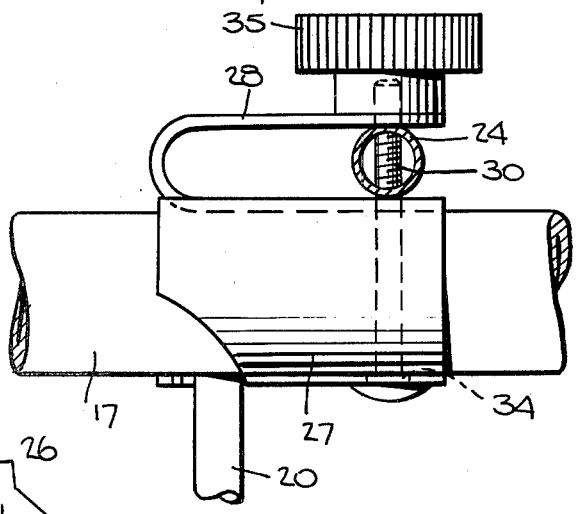
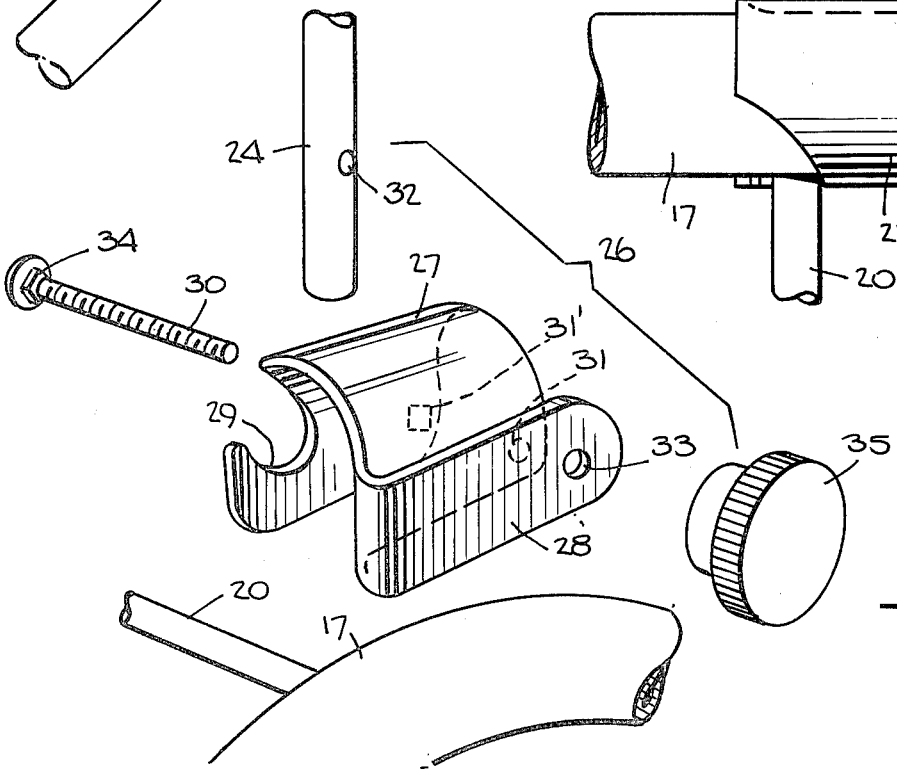
Fig. 5.

CANOPY CONSTRUCTION FOR OUTDOOR FURNITURE

This invention relates to a canopy construction for outdoor furniture. More particularly, this invention relates to a canopy construction for collapsible outdoor furniture.

Proposals have been made for mounting canopies on outdoor furniture frames in order to provide shade in sunny weather. In some cases, hardware has been provided to adapt the canopies for mounting on existing furniture so that the canopies can pivot from a storage condition flat or parallel against the front of the backrest portion of the furniture frames to a position wherein the canopies are directed towards the rear of the furniture frames. Such constructions, however, do not allow the canopy to be folded back out of the way when the chair is in use. Thus, the canopies can form an obstruction at the rear of the frame particularly on a crowded beach. For example, if pivoted to the rearmost condition, the canopies can interfere with a free flow of traffic or with other beach furniture.

Accordingly, it is an object of the invention to provide an outdoor furniture frame with a canopy which can be moved into a storage position against the rear of the frame.

It is another object of the invention to provide a simple mounting arrangement for a canopy which permits storage of the canopy in a flattened condition against the rear of a backrest portion of the furniture frame.

Briefly, the invention is directed to a collapsible furniture frame having a backrest portion including a frame formed of a pair of parallel members each of which has a bent end portion, a cross-bar connecting the bent end portions together and a rod secured between the bent end portions. In addition, a canopy is mounted on the furniture frame and includes a skeletal frame having a pair of legs. In accordance with the invention, a means is provided for pivotally mounting the canopy on the backrest portion. This means includes a pair of clamps, each of which has a U-shaped portion astride a respective bent end portion and a slot in the U-shaped portion which receives the rod. This construction allows each clamp to be located on the furniture frame. In addition, the mounting means includes a leg opposite to and spaced from the U-shaped portion to define a gap to receive a respective canopy leg. Also, a bolt passes through the U-shaped portion, the clamp leg and a leg of the skeletal frame while a means is threaded onto the bolt to tighten the clamp leg against the leg 1 of the skeletal frame. Tightening of this latter means serves to secure the canopy in fixed relation to the furniture frame.

In addition, the leg and U-shaped portion of each clamp are integrally connected to form a stop to prevent pivoting of a canopy leg towards the front of the backrest portion. In this regard, the canopy is pivotal over an angle of about 270° from a position parallel to and to the rear of the backrest portion to a position perpendicular to and over the backrest portion.

For this purpose, the U-shaped portion and the leg of each clamp are formed from a one piece member, for example, stamped out of suitable sheet metal.

These and other objects and advantages of the invention will become more apparent from the following detailed description taken in conjunction with the accompanying drawings in which:

FIG. 3 illustrates a side view of a clamp means in place;

FIG. 4 illustrates a view taken on line 4—4 of FIG. 2; and

FIG. 5 illustrates an exploded view of a clamp means according to the invention.

Figure 1:
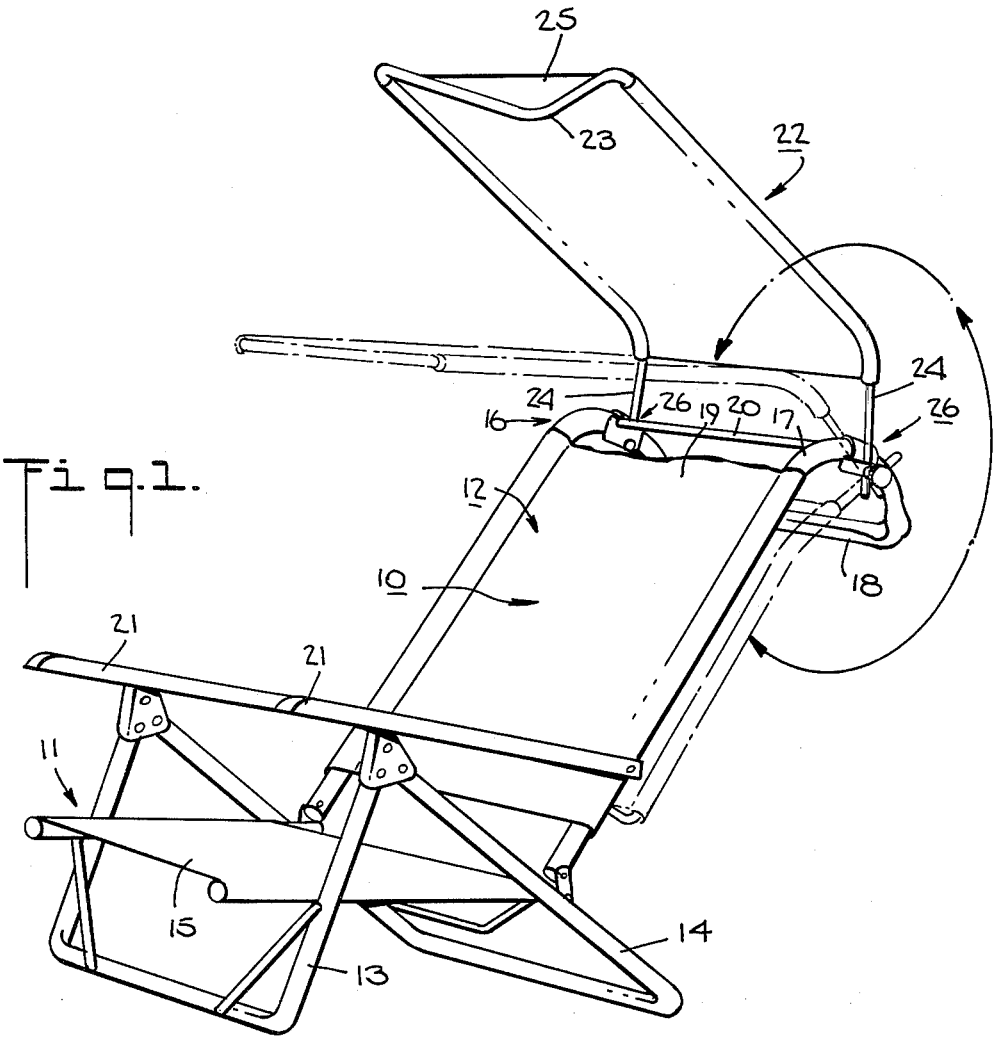
FIG. 1 illustrates a perspective view of a chair having a canopy mounted thereon in accordance with the invention.
Figure 2:
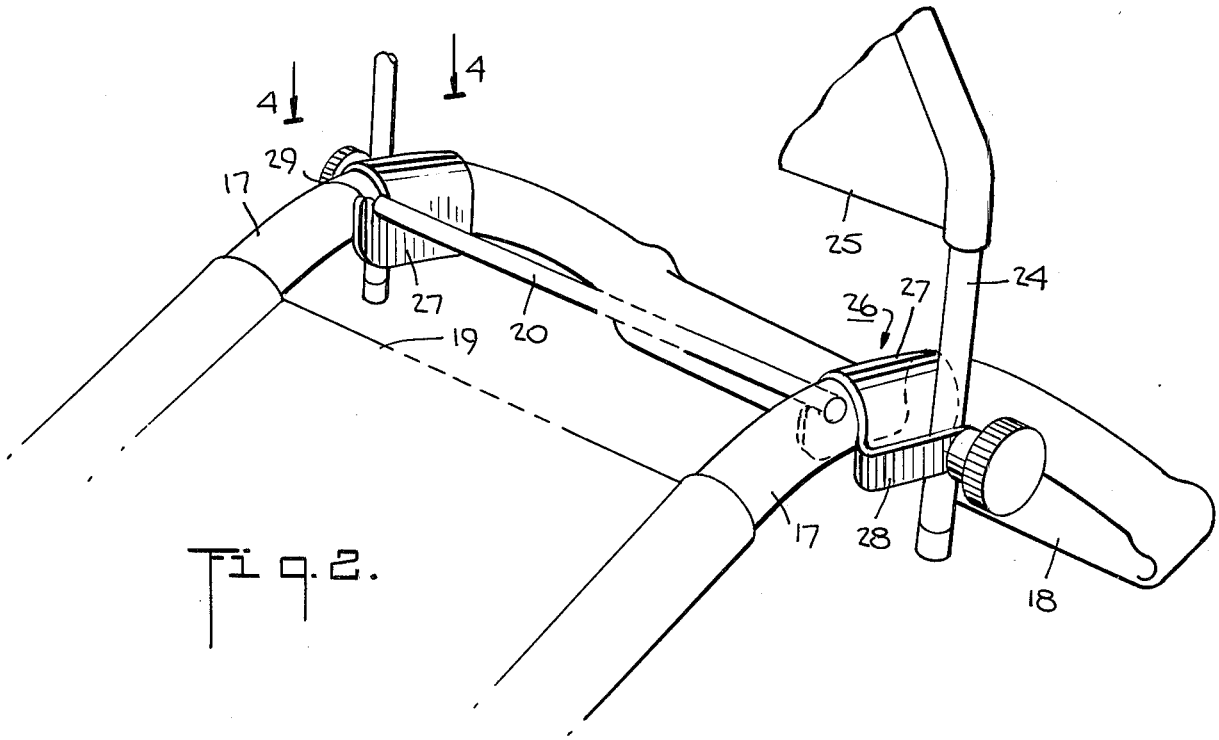
FIG. 2 illustrates an enlarged view of a clamp means in accordance with the invention.

Referring to FIG. 1, the furniture frame 10 is in the form of a chair for outdoor use and is constructed in a manner similar to that as described in U.S. Pat. No. 3,495,868. To this end, the chair 10 includes a seat portion 11 and a backrest portion 12 which are articulated together so as to be collapsible towards each other into a generally flattened configuration when not in use. The seat portion 11 has a pair of leg assemblies 13, 14, each of which is constructed of a pair of U-shaped frames and seat frame 15 to receive an occupant. The backrest portion 12 has a frame 16 which is generally of a U-shape in front view and an inverted J-shape in profile. That is, the frame 16 has a pair of spaced parallel members or bars 17 pivotally connected to the seat frame 15 and a cross-bar 18 which connects the ends of the members 17. The members 17 have straight portions extending away from the points of connection to the seat frame 15 and curved or bent portions at the outermost ends, e.g. the curved portions are in the shape of a ram's horn. In addition, the backrest portion 12 has a strip of back-supporting material 19 secured in known manner between the straight portions of the members 17. Due to the curvature of the ends of the members 17, the cross-bar 18 of the frame 16 is spaced out of the plane of the straight portions of the members 17 and the strip of back supporting material 19.

A hollow stiffening rod 20 is also secured between the members 17 within the curved end portions and out of the plane of the straight portions in order to resist bending or buckling of the members 17. The chair 10 also has a pair of armrests 21 which are secured between the seat portion 11 and the backrest portion 12 in known manner.

A canopy 22 is secured to the top of the chair frame 10 to provide shade for an occupant. To this end, the canopy 22 is formed of a skeletal frame 23 having a pair of parallel hollow legs 24 and a cover 25 which is disposed across the skeletal frame 23. The cover may be made of any suitable fabric and may be provided with looped ends to receive the respective legs 24 of the skeletal frame. The frame 23 is of M-shape so as to impart a degree of tension in the legs 24 and thus keep the cover 25 taut with a smooth aesthetic appearance. As shown, the legs 24 extend through the cover 25 and are connected together by a shaped cross-bar which is disposed outside and adjacent to the cover 25.

In order to mount the canopy 22 on the chair 10, a pair of clamps 26 are provided, one at each side of the chair 10. As shown in FIGS. 2 to 5, each clamp 26 has a one-piece member which when flat is of L-shape. This member is formed into a U-shaped portion 27 and a resilient leg 28 opposite to and spaced from the U-shaped portion 27. The U-shaped portion 27 is positioned to fit astride a respective bent end portion of the furniture backrest member 17 and is provided with a slot 29 so as to receive the rod 20 of the frame 16. As indicated, the slot 29 is positioned on the inside leg of the U-shaped portion 27 relative to the chair 10. In addition, the leg 28 is spaced from the U-shaped portion 27 by a distance sufficient to form a gap to receive a canopy leg 24.

Each clamp also has a bolt 30 which passes through the U-shaped portion 27, the leg 28 and a canopy leg 24. For this purpose, the U-shaped portion 27, leg 28 and canopy leg 24 are provided with suitable apertures 31, 31'; 32; 33. Further, the aperture 31' on the inside of the U-shaped portion 27 is shaped to cooperate with a similarly shaped portion 34 e.g. a square portion, on the bolt 30 to prevent rotation of the bolt 30 when in place. A suitable means such as a knurled knob 35 or wing nut is threaded onto the bolt 30 to abut against and tighten the clamp leg 28 against the canopy leg 24. As shown, the knob 35 is positioned to the outside of the chair 10.

As indicated in FIG. 3, the canopy 22 is pivotable over an angle of about 270° from a position parallel to and at the rear of the backrest portion 12 to a position perpendicular to and over the backrest portion 12. The bent portion of each clamp 26 between the clamp leg 28 and the U-shaped portion 27—which portion is disposed toward the front of the chair 10—forms a stop to prevent pivoting of the canopy 22 any further towards the front of the backrest portion 12.

The bolt 30 of each clamp 26 is also located below and immediately adjacent a respective bent end portion of a backrest portion 12 to prevent rotation of the U-shaped portion 27 relative to the rod 20.

In order to mount the canopy 22 on a chair 10, the U-shaped portions 27 of each clamp 26 are fitted over the bent portion of the backrest portion 12 and slid into place so that the slots 29 receive the stiffening rod 20. Next, the legs 24 of the canopy 22 are inserted between each leg 28 and U-shaped portion 27 of a clamp 26 to align the apertures 33 of the canopy leg with the apertures 31, 31', 33 in the U-shaped portion 27 and the clamp leg 28. Thereafter, the bolts 30 are passed through the respective apertures and the knobs 35 are threaded onto the ends of the bolts 30. The knobs 35 are then tightened against the legs 28 of each clamp 26 so as to secure the canopy 22 in place.

Movement of the canopy 22 within the range of motion can be effected manually. For this purpose, the friction fit caused by the clamps 26 may be overcome by a manual adjustment. If not, the knobs 35 can be loosened to permit pivoting of the canopy 22 and thereafter tightened to secure the canopy in place.

When not in use, the canopy 22 can be pivoted into the rearmost position i.e. behind and parallel to the backrest portion 12 of the chair 10. In this condition, the canopy 22 is disposed within the contours of the furniture frame so as to avoid creation of an obstruction.

The clamps can be easily made from sheet metal materials and can be easily fitted to existing furniture frames. Further, the clamps provide a positive means of preventing pivoting of a canopy 22 towards the front of a backrest portion 12 of the chair 10 or any like structure.

The M-shaped frame 23 provides a bow and arrow type of tension which not only maintains the cover 25 in a taut manner but also imparts a tension on the clamps 26 so as to prevent the clamps 26 from slipping. Thus, the canopy 22 is restrained from moving out of position when the wind blows or when an adjustment is being made in the chair from an upright to a full reclining position. The M-shape of the frame 23 also protects one's head or neck while adjusting the chair from a reclining position to an upright position. Also, the M-shaped frame 23 may be used with the cover 25 to hold newspapers, magazines or light weight books.

The invention thus provides a canopy which can be folded flat against the back of a chair or chaise such that the chair or chaise can be folded compactly to make a neat package. Further, the clamps are constructed so that if the knurled or wing nut 35 becomes loose, the canopy 22 will not fall all the way forward on top of a person's face. Thus, the canopy 22 will be somewhat serviceable, even if the clamps 26 are not holding the canopy 22 in position.

The clamps 26 are further constructed so that in high or gusty winds, the canopy 22 will flip all the way back. In this way, the clamps 26 or canopy frame itself will not become damaged or bent.

I claim:

1. The combination of a collapsible furniture frame having a backrest portion including a frame having a pair of parallel members each having a bent end portion, a cross-bar connecting said bent end portions together and a rod secured between said bent end portions;

a canopy including a skeletal frame having a pair of legs; and means pivotally mounting said canopy on said backrest portion, said means including a pair of clamps, each said clamp having a U-shaped portion astride a respective bent end portion, a slot in said U-shaped portion receiving said rod therein, a leg opposite said U-shaped portion and receiving a respective canopy leg therebetween, a bolt passing through said U-shaped portion, said clamp leg and a respective leg of said skeletal frame, and means threaded onto said bolt to tighten said clamp leg against said respective leg of said skeletal frame.

2. The combination as set forth in claim 1 wherein said canopy is pivotal over an angle of about 270° from a position parallel to and to the rear of said backrest portion to a position perpendicular to and over said backrest portion.

3. The combination as set forth in claim 2 wherein said clamp leg and U-shaped portion of each clamp are integrally connected to form a stop to prevent pivoting of a respective canopy leg towards the front of said backrest portion.

4. The combination as set forth in claim 1 wherein said U-shaped portion and said leg of each clamp form a one-piece member.

5. The combination as set forth in claim 1 wherein said threaded means is a knob.

6. The combination as set forth in claim 1 wherein each bolt is located below and immediately adjacent a respective bent end portion of said backrest frame to prevent rotation of said U-shaped portion of each clamp relative to said rod.

7. The combination as set forth in claim 1 wherein said skeletal frame has a pair of legs and a cross-bar connecting said legs together, said cross-bar being deformed with a bent portion having a tendency to straighten out and bias said legs outwardly of each other, and wherein said canopy further has a cover disposed across said frame to hold said legs while being maintained in taut manner.

8. The combination as set forth in claim 1 wherein said furniture frame is movable from a reclining position to an upright position and said frame is M-shaped to protect an occupant's head while adjusting said furniture frame from a reclining position to an upright position.

9. A canopy for outdoor furniture, said canopy comprising:

a one-piece skeletal frame having a pair of legs and a cross-bar connecting said legs together and being deformed with a bent portion having a tendency to straighten out and bias the legs outwardly of each other; and a cover disposed across said frame to hold said legs in parallel relation while being maintained in a taut manner by said legs.

10. A canopy as set forth in claim 9 wherein said frame is M-shaped.

11. A canopy as set forth in claim 9 wherein said legs are hollow and said cover has looped ends to receive said respective legs, and wherein said frame provides a bow and arrow type of tension to maintain said cover taut.

12. A canopy as set forth in claim 9 wherein said legs extend through said cover with said cross-bar disposed outside and adjacent to said cover.

* * * * *